US006206353B1

(12) United States Patent
Becker et al.

(10) Patent No.: US 6,206,353 B1
(45) Date of Patent: Mar. 27, 2001

(54) CLAMPING DEVICE FOR STRUCTURAL COMPONENTS

(76) Inventors: Karsten Becker, Schillerstr. 8, 32289 Rödinghausen-Bruchmühlen; Uwe Borgolte, Im Vogtland 115, 33104 Paderborn-Marienloh; Josef Kordtomeikel, Ernst-Meurin-Str. 10, 33415 Verl, all of (DE)

( * ) Notice: Subject to any disclaimer, the term of this patent is extended or adjusted under 35 U.S.C. 154(b) by 0 days.

(21) Appl. No.: 09/124,425

(22) Filed: Jul. 29, 1998

(30) Foreign Application Priority Data

Jul. 29, 1997 (DE) ..... 197 32 600

(51) Int. Cl.[7] ..... B25B 1/08
(52) U.S. Cl. ..... 269/32; 269/32
(58) Field of Search ..... 269/32, 91, 93, 269/94, 228

(56) References Cited

FOREIGN PATENT DOCUMENTS 2555207 7/1976 (DE) .
3022376 12/1981 (DE) .
3130942 4/1983 (DE) .
3528337 2/1987 (DE) .
3686385 4/1987 (EP) .
0370914 5/1990 (EP) .

*Primary Examiner*—David A. Scherbel
*Assistant Examiner*—Daniel G. Shanley

(57) ABSTRACT

A clamping device for structural components includes a clamping rod and a clamping arm which can be pivoted from a clamping position into a ready position and vice versa. A rigid lever is rigidly connected through a pivot shaft to the clamping arm. A rigid bracket is rotatably coupled to the lever and to an end of the clamping rod. The length of the rigid bracket between the coupling joints is greater than the distance between the first coupling joint of the bracket with the lever and the longitudinal axis of the clamping rod in the ready position. The second coupling joint between the bracket and the clamping rod is supported on at least one roller which rolls on a forced guide unit which has a length portion corresponding to the pivoting angle of the clamping arm between the ready position and the clamping position, wherein this length portion extends in a straight line parallel to the longitudinal axis of the clamping rod in the ready position, and an end portion which is concave toward the first coupling joint with the coupling joint being in the dead center position thereof. The concave end portion begins in front of a plane which extends through the first coupling joint when the coupling joint is in the dead center position thereof and perpendicularly of the longitudinal axis of the clamping rod in the ready position and the concave end portion ends behind this plane.

6 Claims, 5 Drawing Sheets

CLAMPING DEVICE FOR STRUCTURAL COMPONENTS

BACKGROUND OF THE INVENTION

1. Field of the Invention

The present invention relates to a clamping device or fastening device for structural components.

2. Description of the Related Art

Fastening devices of this type are used for various technical applications for temporarily securing or holding workpieces. These devices must operate quickly and reliably and must ensure frequent load changes without maintenance over long periods of time.

In this regard, known in the prior art from DE 35 28 337 C2 is a clamping device for structural components in which a clamping rod is a component of a piston which is acted upon by a pressurized fluid, such as air or hydraulic liquid, and is axially displaceable in a cylinder. The end of the clamping rod facing away from the piston is connected to a bolt which supports two pairs of rollers. The rollers of the outer pair of rollers travel in straight slots which extend parallel to the longitudinal axis of the clamping rod. The rollers of the inner pair of rollers travel in arc-shaped slots of a clamping arm which can pivot about an axis. The guide slot may also possibly be curved in an arc-shaped manner.

This configuration is supposed to prevent uncontrollably high clamping forces when self-locking occurs in the end position. However, this construction requires a complicated mechanism and, consequently, its manufacture is also complicated Because of the presence of the guide slot, this clamping device has a large structural width. Because of the direct lever transmission, the travel distance of the piston is long and, thus, the construction of the device is inevitably also long. The bent-lever principle is employed in a modified form in this case.

In order to reach the self-locking position in a clamping device operating in accordance with the bent-lever principle, it is necessary to move the bracket forming a component of the bent-lever arrangement above the upper dead center position. This causes the force in the bracket to be increased theoretically up to infinity. In practice, the force is limited by the elastic deformations in the entire system. However, this means that the system is subject to wear. Moreover, it cannot be ensured that in the case of high clamping forces the clamping arm is actually pivoted past the dead center point. The maximum clamping force is determined by the available energy, particularly compressed air. If the cylinder force prevailing in a compressed air cylinder is not sufficiently great in order to apply the necessary clamping force to the clamping arm, the bracket does not move past the dead center point and, thus, does not travel into the self-locking position.

DE 31 30 942 A1 discloses a clamping device for structural components which operates in accordance with the bent-lever principle. A bracket of resiliently yielding construction is hinged to the free end of a piston rod which is connected to a piston which is acted upon by a pressure medium. The bracket is additionally connected to a rigid bent lever which is coupled 90° offset to a clamping arm. The bracket is constructed in such a way that the distance of the coupling joints to the piston rod and the lever is adjustable.

The resilient bracket has the purpose of preventing infinitely high clamping forces. Consequently, only the clamping force can be limited in this clamping device, while a self-locking position cannot be reached. In addition, the fatigue strength and the durability of the bracket should pose problems. The bracket is also difficult to manufacture. Furthermore, the force limitation is dependent on the spring constant and the spring travel.

SUMMARY OF THE INVENTION

Therefore, it is the primary object of the present invention to provide a clamping device for structural components of the above-described type which is of simple construction and makes it possible to limit the force increase by using the bent-lever principle, while still ensuring that in the clamping position the self-locking action guarantees the clamping position even when the clamping energy fails.

In accordance with the present invention, the clamping device includes a clamping rod which can be displaced by pneumatic, hydraulic or electrical energy, and a clamping arm which can be pivoted from a clamping position into a ready position and vice versa. A rigid lever is rigidly connected through a pivot shaft to the clamping arm. A rigid bracket is rotatably coupled to the lever and to an end of the clamping rod The length of the rigid bracket between the coupling joints is greater than the distance between the coupling joint of the bracket with the lever and the longitudinal axis of the clamping rod in the ready position. The coupling joint between the bracket and the end of the clamping rod is supported on at least one roller which rolls on a forced guide means. The forced guide means has a length portion corresponding to the pivoting angle of the clamping arm between the ready position and the clamping position, wherein this length portion extends in a straight line parallel to the longitudinal axis of the clamping rod in the ready position, and an end portion which is concave toward the coupling joint between the lever and the bracket with the coupling joint being in the dead center position thereof. The concave end portion begins in front of a plane which extends through the coupling joint between the bracket and the lever when the coupling joint is in the dead center position thereof and perpendicularly of the longitudinal axis of the clamping rod in the ready position and the concave end portion ends behind this plane.

At the core of the present invention is the fact that the forced guide means for at least one roller arranged at the end of the clamping rod is provided with an end portion which is concave toward the coupling joint between the lever and the bracket in the dead center point thereof. This concave end portion begins a short distance in front of the plane which extends through the coupling joint between the lever and the bracket when this coupling joint is in the dead center point determined by the clamping position of the clamping arm, and this concave end portion ends behind this plane.

When the coupling joint between the bracket and the clamping rod reaches the beginning of the concave end portion in front of this plane, the clamping arm is in the clamping position and the maximum clamping force has been built up. No further force increase takes place. However, the clamping force which still continues to act on the clamping rod causes the coupling joint between the bracket and the clamping rod to be moved past the plane until this coupling joint has reached the end of the concave end portion located behind the plane. The maximum clamping force is always maintained during this movement. Behind the plane, the bracket is in the self-locking range. However, when the clamping energy is taken away in this position, the complete clamping force is maintained without losses.

Consequently, the special advantage provided by the invention is the fact that the force limitation is ensured in a simple manner by the concave end portion. This ensures a problem-free, self-locking action after passing the dead center point. In addition, the clamping device is of a very compact construction because the distance transmission between the lever and the bracket according to the present invention only requires a short travel distance of the clamping rod.

The present invention also makes it possible to adjust the pivoting angle of the clamping arm between the ready position and the clamping position as desired. Opening angles of especially 45°, 60°, 90° and 115° up to a maximum opening angle of 135° can be provided merely by using movement-limiting pieces or by replacing the clamping rod. Moreover, the clamping device can be provided without problems with an integrated position monitoring device.

The housing for supporting the clamping arm, the lever, the bracket and the clamping rod is constructed in such a way that an abutment cooperating with the clamping arm for securing the position of the work piece to be worked on can be arranged releasably in the housing.

In accordance with a particularly useful embodiment of the invention, the concave end portion of the forced guide means extends over an arc length which corresponds to a pivoting angle of the bracket of 6° to 10°, preferably 8°, extending across the plane through the coupling joint between the lever and the bracket in the dead center position. This ensures the self-locking action of the bracket when moved past the plane by 4°.

In accordance with a preferred feature of the present invention, the concave end portion of the forced guide means is curved in the shape of a circular arc. The circular arc has a radius which corresponds to the length of the bracket between the coupling joints plus the radius of the roller.

In accordance with another feature, the forced guide means, the lever, the bracket and the roller are arranged in a two-piece housing which can be connected to the guide means for the clamping rod. In this manner, these components are well protected against external influences even in rough operating conditions. Since the housing is composed of two pieces, it can be easily manufactured and assembled without problems. The guide means is formed particularly by a cylinder, if, in accordance with a preferred embodiment, the clamping rod is constructed as a piston rod connected with a piston to which compressed air or a hydraulic medium can be applied. The necessary deflection of the clamping rod when the roller makes contact with the concave end portion is compensated by the sealing means at the cylinder for the clamping rod.

In accordance with another feature, the clamping arm laterally surrounds the housing with two hinge arms and is rigidly connected to the pivot shaft which is integrally manufactured with the lever and whose ends extend out of the housing. This ensures a uniform force transmission without misalignment of the clamping rod to the clamping arm.

In accordance with a particularly useful feature, the pivot shaft is polygonally shaped in the end sections supporting the joint arms. In particular, the pivot shaft may be rectangular. In that case, the joint arms are provided with appropriate recesses and/or clamping pieces through which the joint arms can be secured in a defined manner to the pivot shaft. The pivot and. the lever are preferably a single component which is manufactured by turning and cutting operations.

DESCRIPTION OF THE PREFERRED EMBODIMENTS

Figure 2:
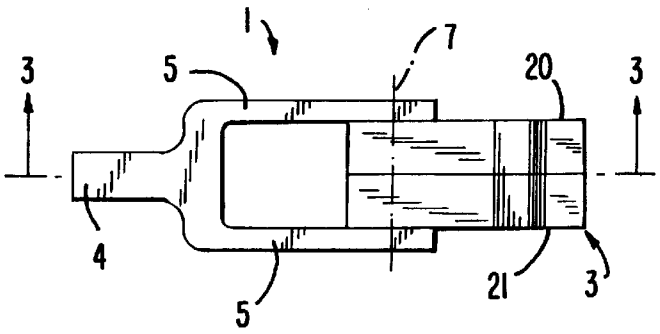
FIG. 2 is a top view of the clamping device of FIG. 1.
Figure 1:
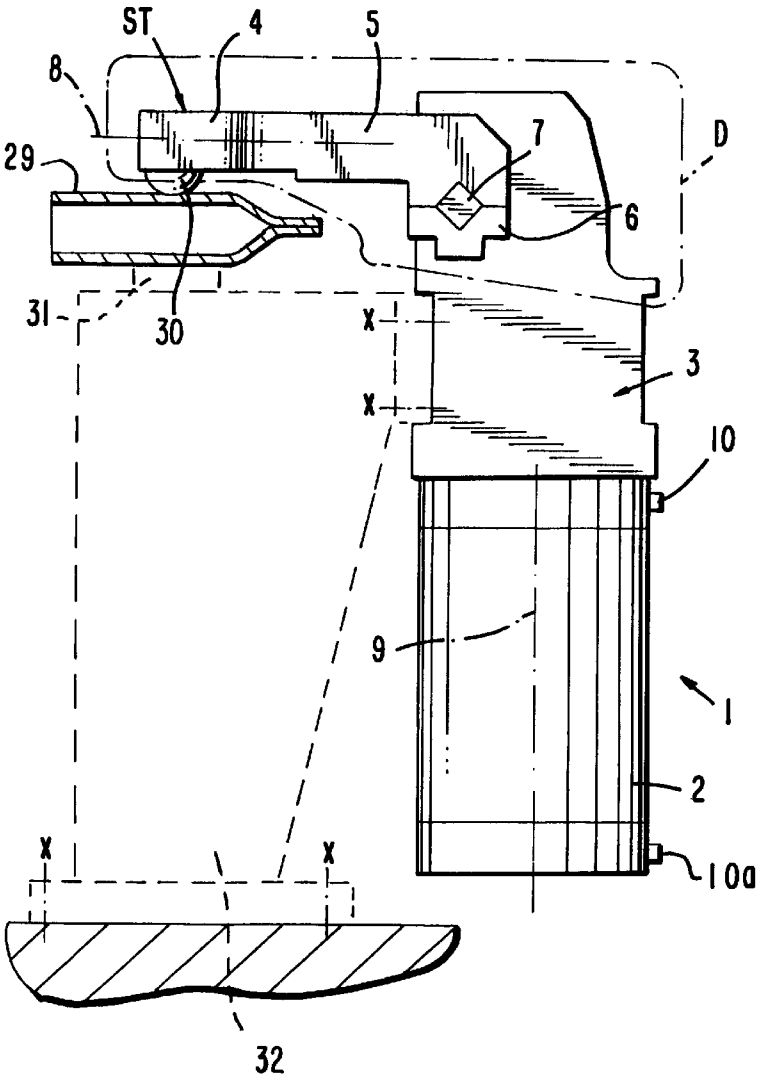
FIG. 1 is a schematic side view of a clamping device for structural components according to the present invention.

FIGS. 1 and 2 of the drawing show a compressed air-operated clamping device 1 for structural components. The clamping device 1 includes a cylinder 2 operated by compressed air for guiding a piston with piston rod, not shown in detail, a two-piece housing 3 connected to the cylinder 2, and a bent-lever system, not illustrated in FIGS. 1 and 2, integrated in the housing for transmitting force exerted by the compressed air on the piston to a pivotable clamping arm 4.

The clamping arm 4 has a U-shaped configuration with two joint arms 5 which are releasably fastened through clamping pieces 6 to a pivot shaft 7 which has a rectangular cross section and extends out of the housing 3. In the clamping position ST illustrated in FIGS. 1 and 2, the longitudinal axis 8 of the clamping arm 4 extends perpendicularly of the longitudinal axis S of the cylinder 2. The compressed air connection of the annular space 2*a* is identified by 10 and the connection of the piston space 2*b* is identified by 10*a*.

FIG. 1 further shows a component or workpiece 29 clamped by the clamping arm 4. Specifically, the component 29 is clamped between a spherical projection 30 of the clamping arm 4 and an abutment 31 mounted on a console 32.

As can be seen in FIGS. 3 to 6 in more detail, the clamping arm 4 is connected in the interior of the housing 3 offset by 90° to a rigid lever 11. The lever 11 forms an integral component of the pivot shaft 7.

Figure 3:
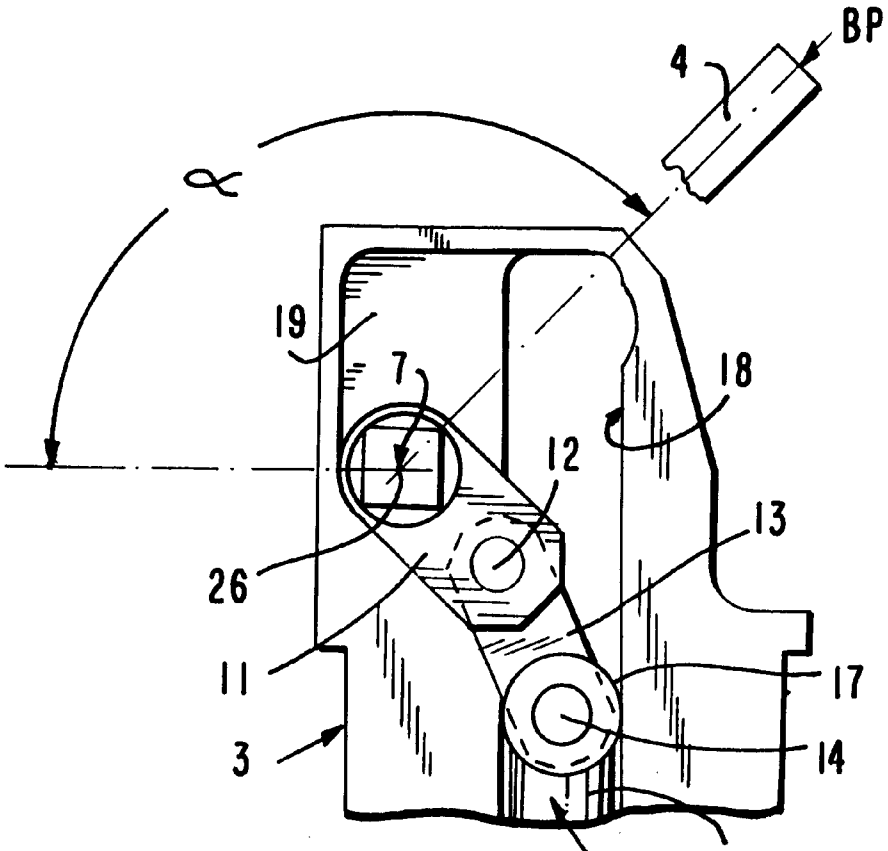

At the end facing away from the pivot shaft 7, the lever 11 is connected through a coupling joint 12 to a rigid bracket 13 which, in turn, is connected through a coupling joint 14 to the end 15 of a clamping rod 16, as shown in FIG. 3. The coupling joint 14 rests on a roller 17 which rolls on a forced guide means 18 in the housing 3. A recess 19 in the halves 20, 21 of the housing 3 is adapted to the magnitude of the pivoting movements of the lever 11 and the bracket 13.

Figure 11:
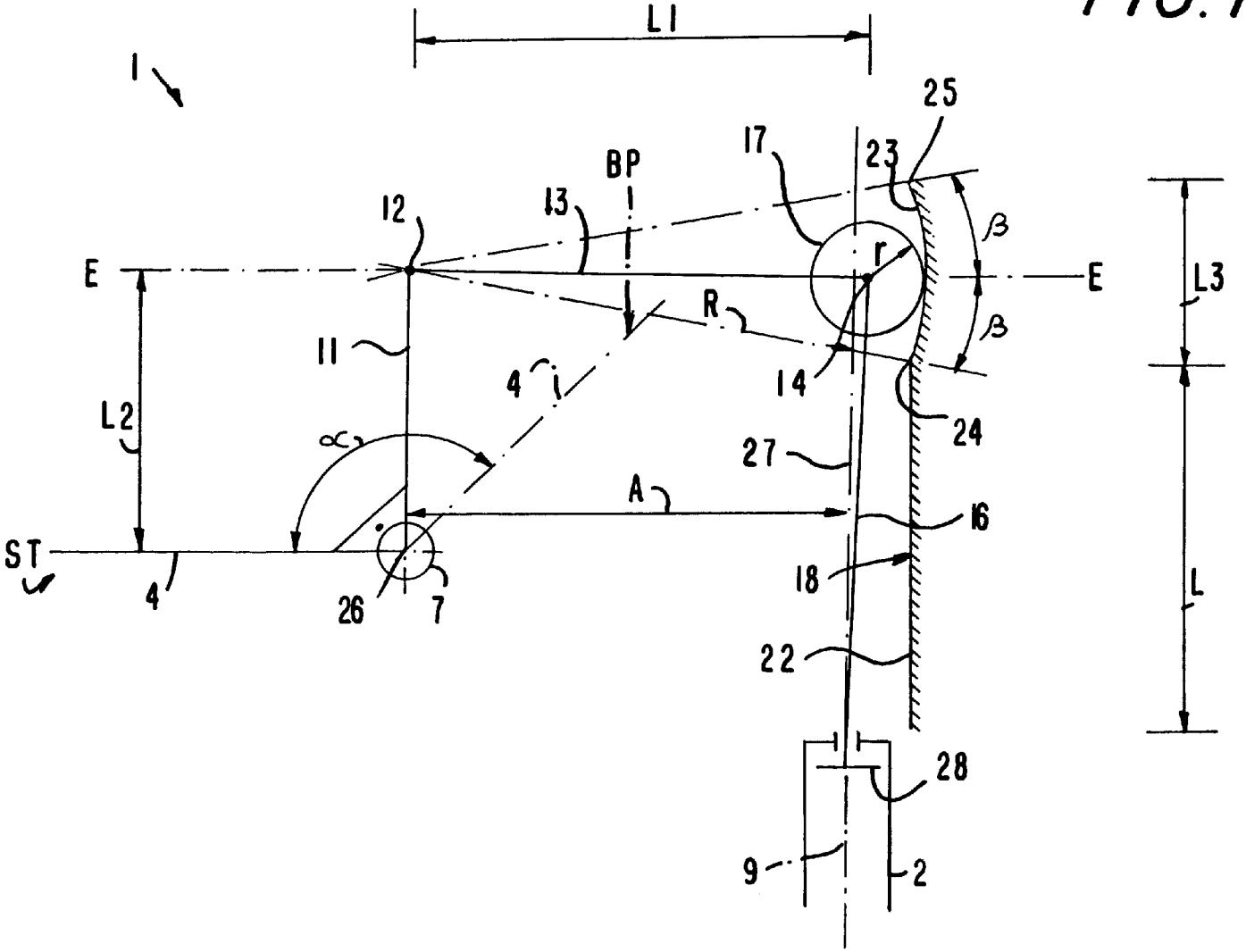
FIG. 11 is a detailed illustration, on an even larger scale, of FIG. 9.

As purely schematically shown in FIG. 11, the forced guide means 18 for the roller 17 is composed of a straight length portion 22 and an arc-shaped curved end portion 23. The length L of the straight length portion 22 corresponds to the magnitude of the pivoting angle $\alpha$ of the clamping arm 4 between the ready position BP and the clamping position ST. The straight length portion 22 extends parallel to the longitudinal axis 9 of the cylinder 2. The end portion 23 is concavely curved toward the coupling joint 12 between the lever 11 and the bracket 13 in the dead center position thereof (clamping position ST of 4). The end portion 23 begins at 24 in front of the plane E—E extending through the coupling joint 12 when in the dead center position and extends perpendicularly of the longitudinal axis 9 of the cylinder 2, and the end portion 23 ends at 25 behind this plane E—E. The arc length L3 of the end portion 23 corresponds to the angle β between the points 24 and 25. The angle β between the plane E—E and the points 24, 25 of the concave end portion 23 is 4° each.

FIG. 11 further shows that the length L1 of the bracket 13 between the coupling joints 12 and 14 is greater than the distance A between the coupling joint 12 and the longitudinal axis 27 of the clamping rod 18 extending coaxially with the longitudinal axis 9 of the cylinder 2.

The operation of the clamping device 1 according to the present invention shall now be explained in more detail below with the aid of FIGS. 3 to 11.

Figure 4:
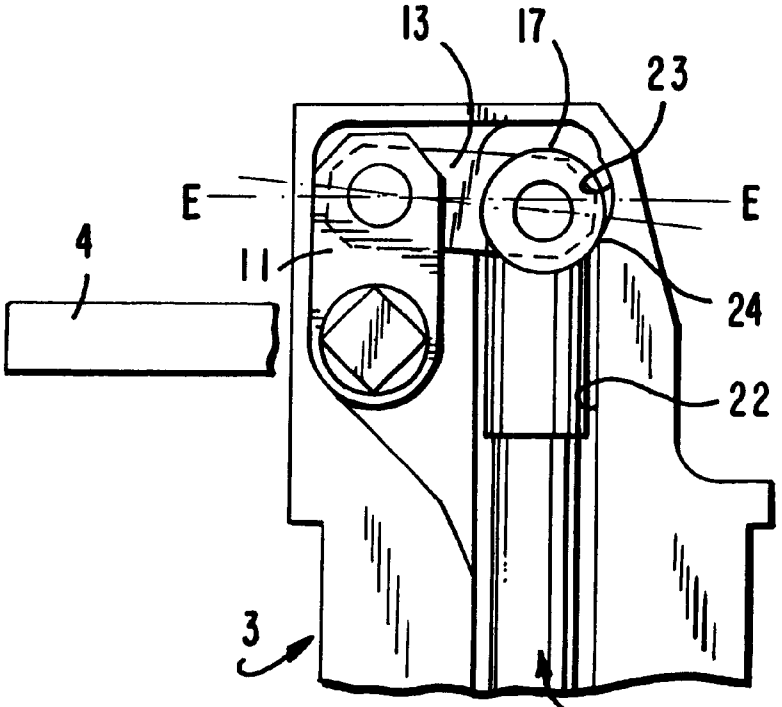
FIGS. 3 to 6 are vertical longitudinal sectional views, on a larger scale, taken along sectional A—A of FIG. 2 and corresponding to the detail D of FIG. 1, shown in four different positions of operation.
Figure 8:
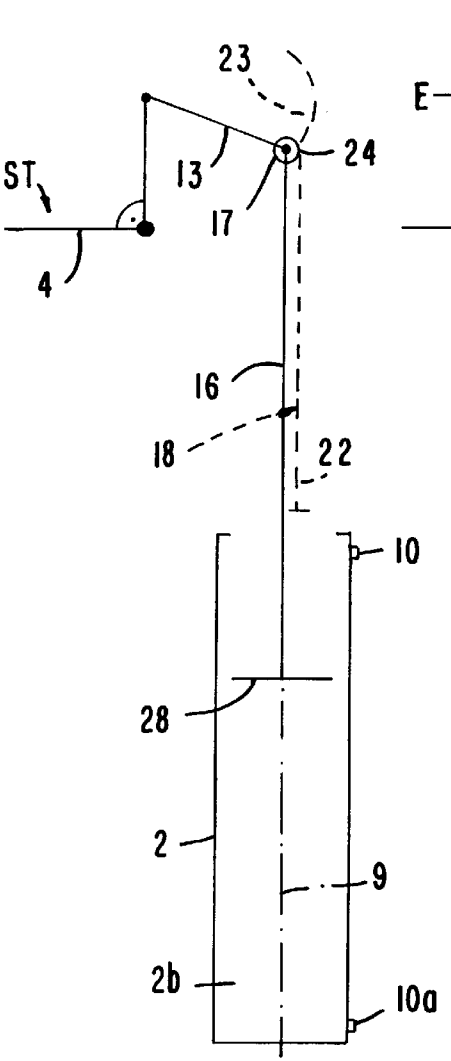
Figure 7:
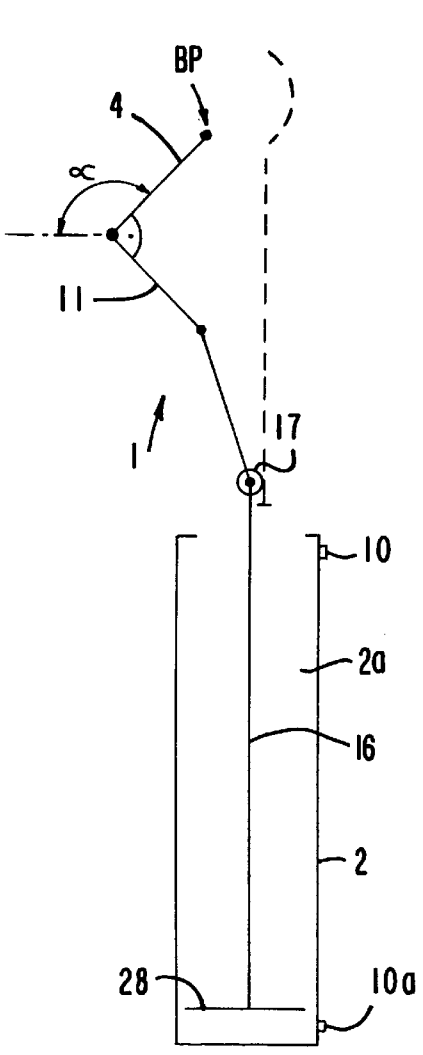

FIGS. 3 and 7 shown the ready position BP of the clamping arm 4. The opening angle α is 135°. The clamping device 1 is completely opened. Compressed air is applied through the compressed air connection 10 to the annular space 2*a* of the cylinder 2. By applying compressed air to the piston 28 in the piston space 2*b* of the cylinder 2, the piston 28 is moved in the longitudinal direction of the cylinder 2, as illustrated in FIGS. 4 and 8. This causes the roller 17 to roll on the length portion 22 of the forced guide means 18. Once the roller 17 has reached the lower end 24 of the concave end portion 23 as seen in FIGS. 4 and 8 of the drawing, the clamping arm 4 has been pivoted by 135° into the clamping position ST. The opening angle is now 0°. The maximum clamping force has been reached.

By a further application of compressed air to the piston 28 through the compressed air connection 10*a* of the piston space 2*b*, the clamping rod 16 is moved further and pivots the bracket 13 about the coupling joint 12 which is now fixed in its location between the lever 11 and the bracket 13 until it reaches the plane E—E which extends through the coupling joint 12 and extends perpendicularly of the longitudinal axis 9 of the cylinder 2. As this occurs, the roller 17 rolls on the concave end portion 23 without an increase of the already achieved clamping force, see FIGS. 5, 9 and 11.

Figure 6:
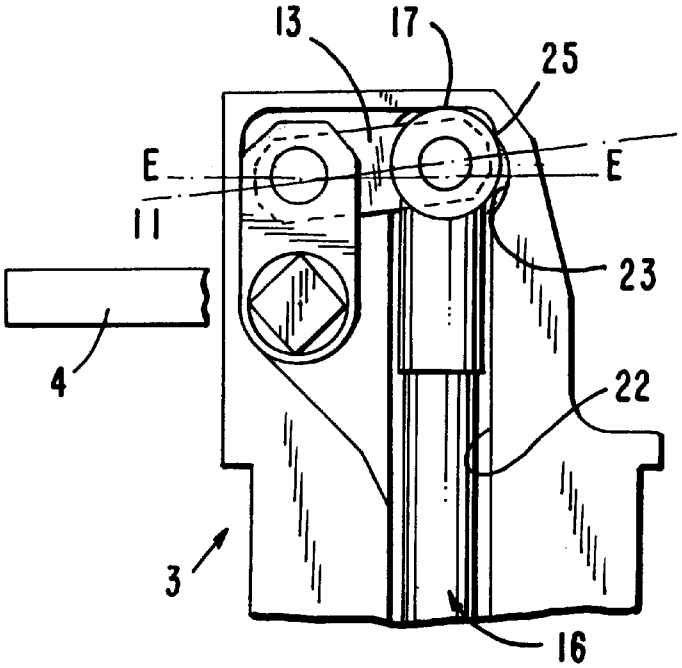
Figure 5:
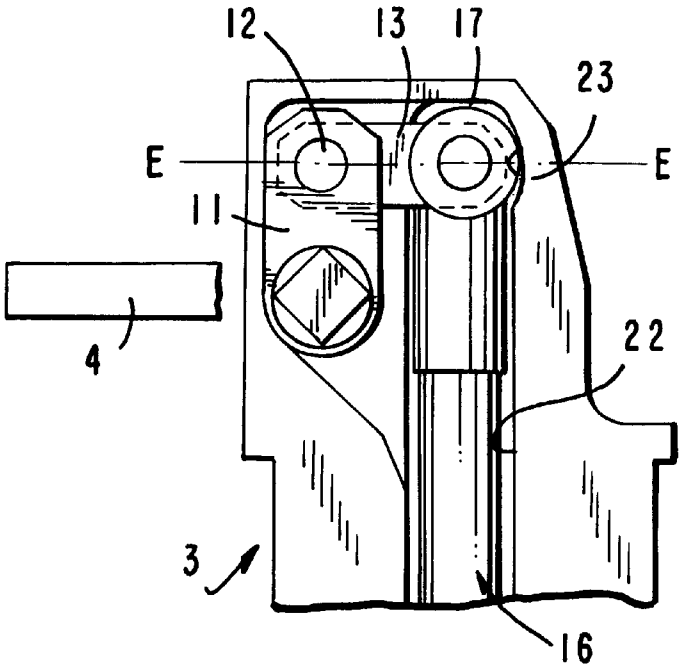
Figure 10:
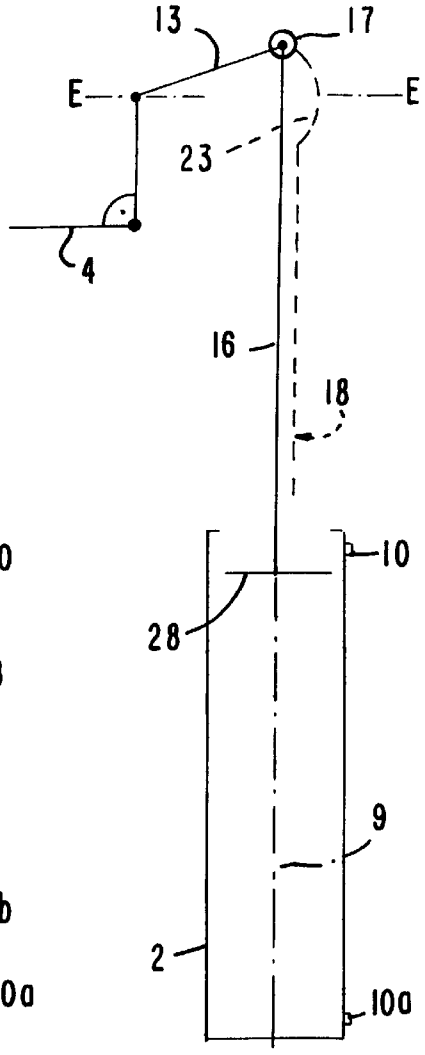
FIGS. 7 to 10 are schematical illustrations corresponding to FIGS. 3 to 6.
Figure 9:
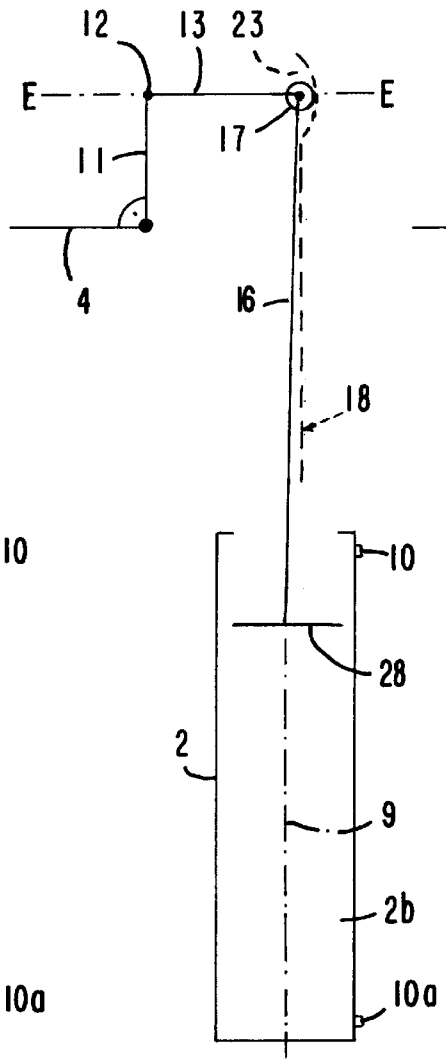

By continuing the application of compressed air to the piston 28, the bracket 13 is moved beyond the plane E—E, as shown in FIGS. 6 and 10, until the roller 17 has reached the upper end 25 of the concave end portion 23.

In this position, if a drop of the compressed air occurs, the complete clamping force would still be maintained because the bracket 13 is above the plane E—E by 4° and, thus, is in the range of self-locking action.

While specific embodiments of the invention have been shown and described in detail to illustrate the inventive principles, it will be understood that the invention may be embodied otherwise without departing from such principles.

We claim:

1. A clamping device comprising a clamping rod configured to be displaced by pneumatic, hydraulic or electrical energy, a clamping arm mounted so as to be pivotable between a clamping position and a ready position, a rigid lever rigidly connected through a pivot shaft to the clamping arm, a rigid bracket rotatably coupled to the lever in a first coupling joint and to an end of the clamping rod in a second coupling joint, the rigid bracket having a length between the first and second coupling joints which is greater than a distance between the first coupling joint and a longitudinal axis of the clamping rod in the ready position, at least one roller for supporting the second coupling joint, the at least one roller being configured to roll on a forced guide means, the forced guide means having a length portion corresponding to a pivoting angle of the clamping arm between the ready position and the clamping position, wherein the length portion extends in a straight line parallel to the longitudinal axis of the clamping rod in the ready position, the forced guide means further having an end portion, the end portion being concave toward the first coupling joint in a dead center position thereof, wherein the concave end portion is positioned relative to a plane, extending through the first coupling joint when the first coupling joint is in the dead center position thereof and perpendicularly of the longitudinal axis of the clamping rod in the ready position, such that the concave end portion begins at a side of the plane facing the ready position and ends in an upper end at a side of the plane facing away from the ready position, wherein the concave end portion has a radius corresponding to the distance between the first and second coupling joints plus the radius of the roller, and wherein the at least one roller is configured to pass through the plane in a direction toward the upper end and to provide a self-locking action when positioned at the upper end.

2. The clamping device according to claim 1, wherein the concave end portion of the forced guide means extends over an arc length corresponding to a pivoting angle of the bracket of 6° to 10° across the plane.

3. The clamping device according to claim 2, wherein the pivoting angle is 8°.

4. The clamping device according to claim 1, further comprising a two-piece housing configured to be connectable to a guide member for the clamping rod, wherein the forced guide means, the lever, the bracket and the roller are mounted in the housing.

5. The clamping device according to claim 4, wherein the clamping arm has two joint arms laterally surrounding the housing, the pivot shaft and the lever being integrally connected to each other, wherein the joint arms have ends extending out of the housing and non-rotatably connected to the pivot shaft.

6. The clamping device according to claim 5, wherein the pivot shaft has end portions supporting the joint arms, wherein the end portions have a polygonal cross-section.

* * * * *

UNITED STATES PATENT AND TRADEMARK OFFICE

CERTIFICATE OF CORRECTION

PATENT NO. : 6,206,353 B1
DATED : March 27, 2001
INVENTOR(S) : Karsten Becker et al.

It is certified that error appears in the above-identified patent and that said Letters Patent is hereby corrected as shown below:

Title page,
Item [73] Assignee, Benteler AG, Paderborn (DE)

Signed and Sealed this

First Day of January, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,206,353 B1
DATED : March 27, 2001
INVENTOR(S) : Karsten Becker et al.

It is certified that error appears in the above-identified patent and that said Letters Patent is hereby corrected as shown below:

Title page,
Item [76], Inventors, should read:

-- Karsten Becker, Schillerstr. 8, 32289 Rödinghausen-Bruchmühlen;
Uwe Borgolte, Im Vogtland 115, 33104 Paderborn-Marienloh;
Josef Kordtomeikel, Ernst-Meurin-Str. 10, 33415 Verl, all of (DE) --

Signed and Sealed this

First Day of October, 2002

*Attest:*

*Attesting Officer*

JAMES E. ROGAN
*Director of the United States Patent and Trademark Office*